US005215516A

United States Patent [19]

Stutt

[11] Patent Number: 5,215,516

[45] Date of Patent: Jun. 1, 1993

[54] BOX MAKING APPARATUS

[75] Inventor: Colin Stutt, Bristol, Great Britain

[73] Assignee: The Langston Machine Company Limited, Bristol

[21] Appl. No.: 925,818

[22] Filed: Aug. 4, 1992

Related U.S. Application Data

[63] Continuation of Ser. No. 732,570, Jul. 19, 1991, abandoned, which is a continuation-in-part of Ser. No. 333,357, Apr. 4, 1989, abandoned.

[51] Int. Cl.[5] ..... B65H 35/00

[52] U.S. Cl. ..... 493/365; 493/369; 493/64; 83/877; 83/878

[58] Field of Search ..... 493/59, 60, 64, 65, 493/66, 70, 72, 82, 83, 123, 160, 340, 342, 362, 363, 369, 355, 365; 83/877, 878

[56] References Cited

U.S. PATENT DOCUMENTS

| | | | |
|---|---|---|---|
| 810,971 | 1/1906 | Palmer . | |
| 1,186,087 | 6/1916 | Feeley . | |
| 1,430,287 | 9/1922 | Crowell . | |
| 3,254,827 | 6/1966 | Chapman | 229/48 |
| 3,369,433 | 2/1968 | Johansson | 83/878 |
| 3,534,646 | 10/1970 | Tyer, Jr. . | |
| 3,604,317 | 9/1971 | Baun | 93/58 ST |
| 3,605,534 | 9/1971 | Barr | 83/4 |
| 3,716,435 | 2/1973 | Jensen et al. | 156/195 |
| 4,540,391 | 9/1985 | Fries, Jr. | 493/287 |
| 4,581,008 | 4/1986 | Reil | 493/363 |

FOREIGN PATENT DOCUMENTS

| | | |
|---|---|---|
| 0226481 | 6/1987 | European Pat. Off. . |
| 2110721 | 5/1972 | France . |
| 384794 | 12/1932 | United Kingdom . |

*Primary Examiner*—Bruce M. Kisliuk
*Assistant Examiner*—Jack Lavinder
*Attorney, Agent, or Firm*—Seidel, Gonda, Lavorgna & Monaco

[57] ABSTRACT

A method and apparatus are disclosed for preparing box blanks of corrugated board which include feeding the blanks of corrugated board in succession along a feed path and in a direction parallel to opposite edges of the blanks. The blank is folded to form a flat tube prior to its formation into a box. The opposite edges of the folded blank overlap and are reduced in thickness in the areas in which the overlap occurs. Cutting means adjacent to the feed path removes material from opposite faces of the respective edges. The resulting flaps overlap with an unreduced portion of the board of the finished box.

9 Claims, 5 Drawing Sheets

BOX MAKING APPARATUS

This is a continuation of co-pending application(s) Ser. No. 07/732,570 filed on Jul. 19, 1991, now abandoned, which is a continuation-in-part, of co-pending prior application Ser. No. 07/333,357 filed Apr. 4, 1989, now abandoned, which claims foreign priority based upon British patent application Number 8,623,896, filed Oct. 5, 1987.

This invention is concerned with the manufacture of blanks of corrugated board used to form boxes.

At one stage during the manufacture of such boxes the blanks are folded a long pre-formed crease lines, and opposite edges of each blank are stuck together in overlapped relationship, so as to form a flat folded box. A disadvantage of this has been that when the flat folded boxes are stacked one on top of another, the overlapped portion (which is usually adjacent to one of the creases) has been of double thickness, thus causing the flat-folded boxes to stack unevenly.

It is usual in box blanks to use double faced corrugated board in which a single layer of corrugated medium is sandwiched between two outer liners, but in larger containers the board may be still thicker, having two or even three layers of corrugated medium. In such a case the extra thickness accentuates the uneven stacking.

It has been proposed in U.S. Pat. No. 1,186,087 to provide a box made of corrugated board in which overlapped portions of the blank which are joined to form a flat-folded box are spaced from the edges of the box (i.e. from the creases in the blank) and are each cut away to reduce their thickness. However, no practical way is described for reducing the thickness of the overlapped portions. The present invention is concerned with practical ways of doing so.

The invention will now be described, by way of example, with reference to the accompanying drawings. In these drawings.

Figure 1:
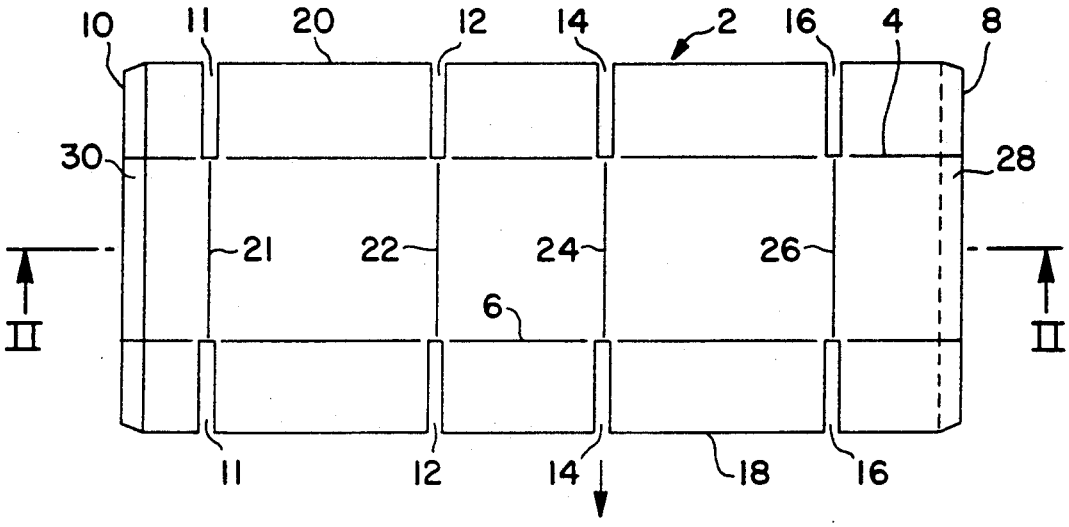
FIG. 1 is a plan of a box blank having defined areas which have been reduced in thickness.
Figure 2:
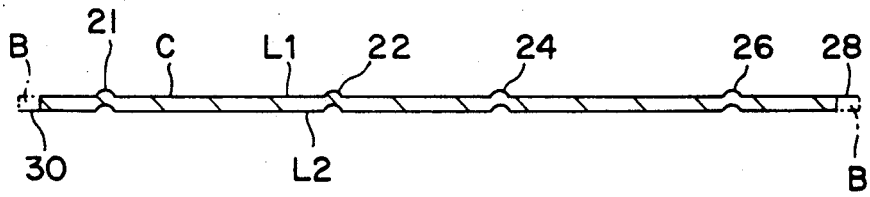
FIG. 2 is a section on the line II—II of FIG. 1.
Figure 3:
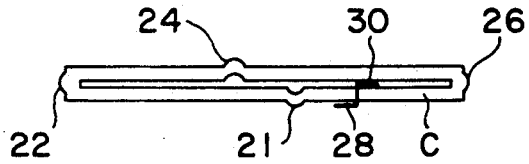
FIG. 3 is a section through the blank, similar to FIG. 2 but after the blank has been folded into a flat tube.

Referring to FIGS. 1 to 3 of the drawings, 2 is a box blank made from double faced corrugated board consisting of a single layer C of corrugated medium sandwiched between two flat outer liners L1, L2. The blank has parallel score lines 4 and 6 extending between the blank edges 8 and 10; opposed pairs of transverse slots 11, 12, 14 and 16 extending between the score lines and the blank edges 18, 20; and score lines 21, 22, 24 and 26 aligned with and extending between respective slots 11, 12, 14 and 16. Flaps 28 and 30 extend respectively from the edges 8 and 10, the flaps being reduced in thickness over their whole areas, from opposite faces of the blank, as shown in FIG. 2, at each end of the blank. The blank 2 is then folded, in known manner, along crease lines 22 and 26 to form the blank into a flat tube (i.e. a flat folded box) so that the remaining parts of flaps 8 and 10 overlap, and are stuck to, the opposite ends of the blank, as shown in FIG. 3.

Figure 4:
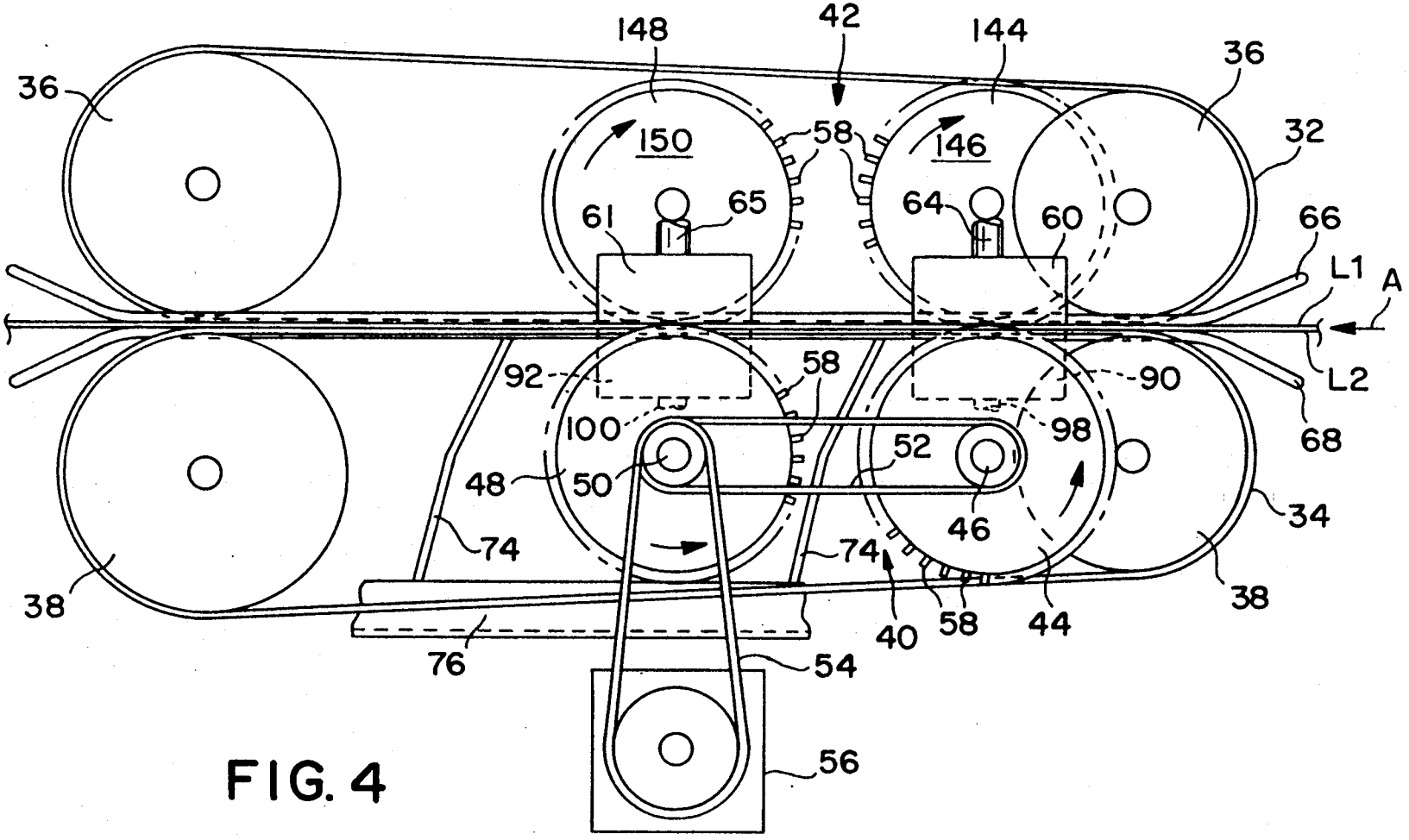
FIG. 4 is a diagrammatic side view showing one form of apparatus for reducing the thickness of the defined areas of the blank of FIG. 1.

Reference will now also be made to FIGS. 4 to 7 of the drawings. Box blanks are fed in the direction of the arrow A in FIG. 4 from printing and slotting apparatus (not shown) of any known form, one at a time and spaced apart in the direction of feed. The blanks are as described above except that, at this stage, the flaps 8, 10 have not been reduced in thickness, and thus are as shown in dotted lines at B in FIG. 2. Each blank, lying flat, is fed with the liner L1 uppermost and edge 18 leading towards two pairs of belts which are spaced apart across the width of the blank so that the edges 8, 10 extend beyond the belts. Each pair of belts consists of respective upper and lower belts 32 and 34 between adjacent runs of which a blank is gripped and fed along a feed path defined by the adjacent runs of the belts, the belts extending between respective pulleys 36, 38 (FIG. 4).

Whilst a blank is being fed by the belts 32, 34 the flaps 28, 30 are reduced in thickness over their whole areas by cutting away one of the liners L1, L2 and substantially the whole of the layer C, by means of respective cutting units indicated generally at 40 and 42. As the units 40, 42 are very similar, in the following description the same reference number will be used for like parts in both units but with 100 added to the parts of unit 42.

Each unit 40, 42 consists of a first circular cutter 44, 144 fixed on a shaft 46, 146 and, downstream therefrom, a second circular cutter 48, 148 fixed on a shaft 50, 150.

Figure 5:
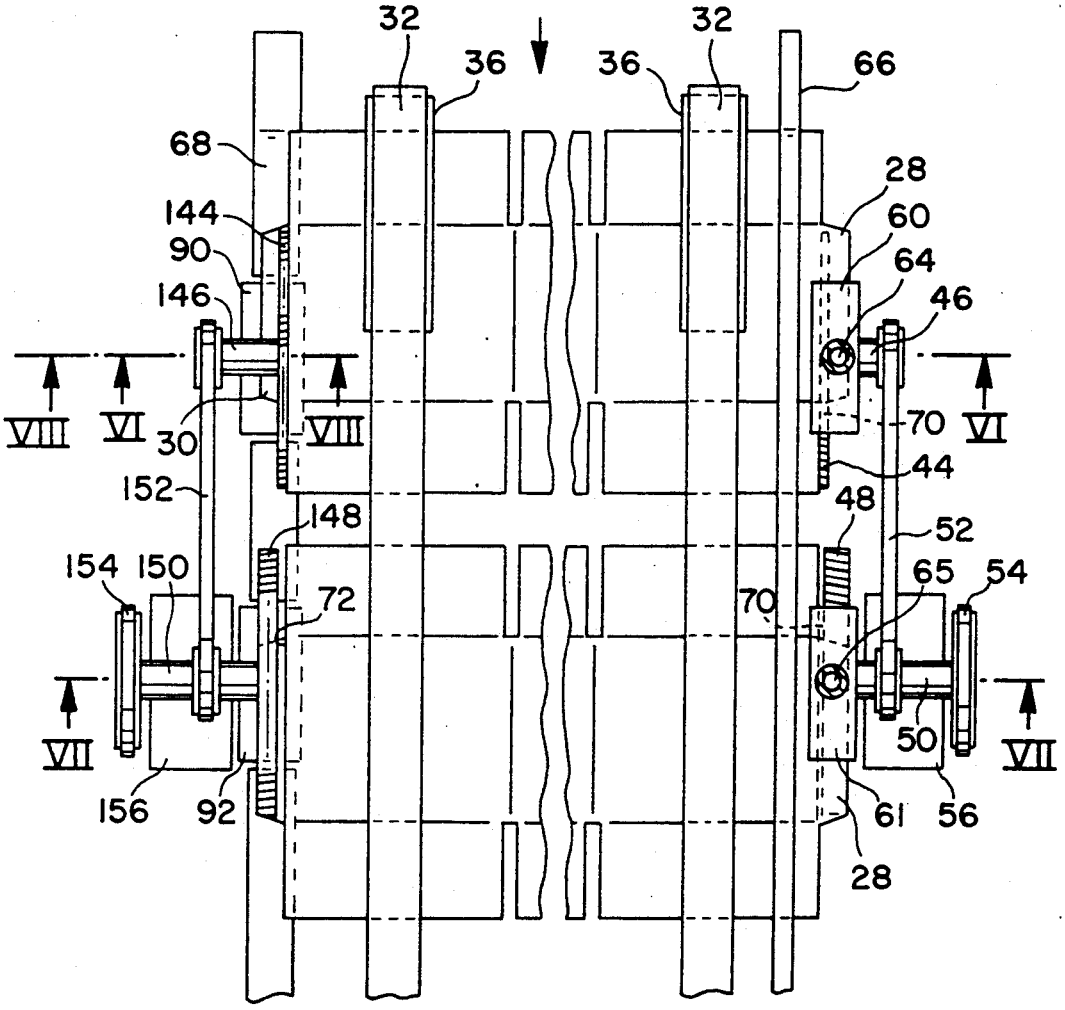
FIG. 5 is a plan view of part of FIG. 4.

The shafts 46, 50 and 146, 150 are driven by means of respective belts 52, 54 and 152, 154 from motors 56, 156, so that the peripheral speed of the cutters 44, 144, 48, 148 is 10 to 12 times faster than the speed at which the blanks are fed by the belts 32, 34, with all the cutters rotating in a vertical plane. As viewed in FIG. 4 the cutters 44, 48 rotate in an anticlockwise direction and the cutters 144, 148 rotate in a clockwise direction. The shafts 46, 50 are mounted so that the cutters 44, 48 are positioned below the feed path of the blanks and the shafts 146, 150 are mounted so that the cutters 144, 148 are positioned above the feed path. Each cutter is provided with a number of cutting edges 58 in a similar manner to that of a milling cutter. Positioned above each of the cutters 44, 48 is a respective suction box 60, 61 having slots 62, 63 in their bottom sides (see FIGS. 6 and 7) and to which suction is applied through pipes 64, 65. Similarly, positioned below each of the cutters 144, 148 is a respective section box 90, 92 having slots 94, 96 in their top sides and to which suction is applied through pipes 98, 100. A fixed plate 66 is positioned as shown in FIGS. 4, 5 to help support the blank near the edge 8 thereof, and a further fixed plate 68 supports the edge 10 of the blank.

Figure 6:
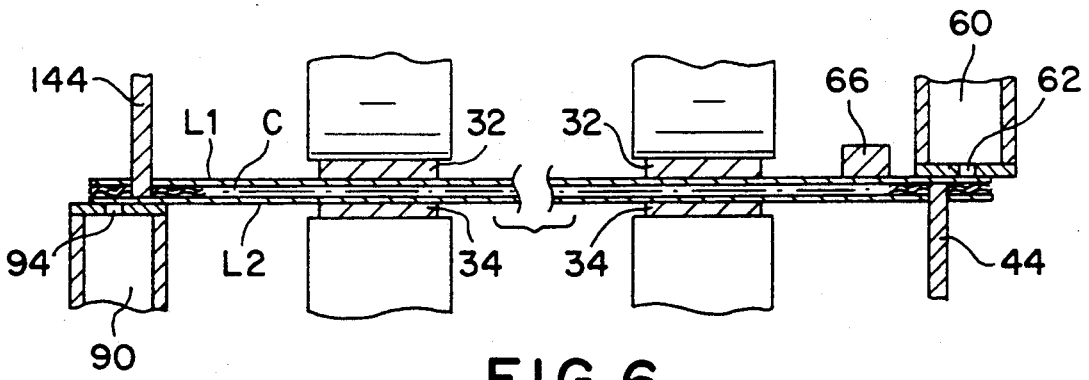
FIG. 6 is a section on the line VI—VI of FIG. 5, drawn to a larger scale.
Figure 7:
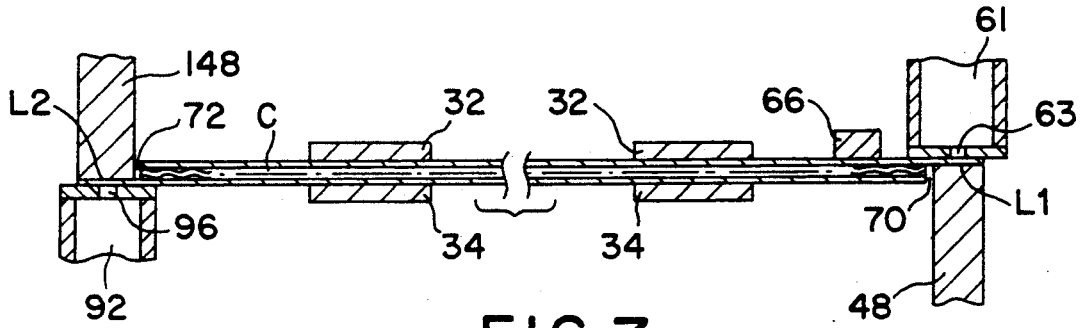
FIG. 7 is a section on the line VII—VII of FIG. 5, drawn to a larger scale.

The operation of the apparatus will now be described by following the passage of a single blank through the appartus. After having printing and slotting operations performed on it, the blank is fed towards the cutters 44, 144. The latter are positioned so that when they engage the respective flaps 28, 30, they do so in line with the edges 8, 10 of the blank. Just prior to the flap 8 engaging the cutter 44, suction is applied through the slot 62 so as to hold the flap flat as it passes the cutter. On engaging with the leading end of the flap 28, the cutter starts to cut through the bottom liner L2 and also the corrugated layer C, leaving the top liner L1 uncut, as shown in FIG. 6. As the blank continues to be fed by the belts 32, 34, the cutter 44 makes a narrow cut 70 (the cutter may be, for example, 3 mm wide) along the blank, at the base of the flap 28, in line with the edge 8. When the trailing end of flap 28 passes out of engagement with the cutter 44, the area of flap 28 which is to be reduced in thickness is delineated from the rest of the blank by the narrow cut 70. Also the flap 28 passes away from the suction box 60.

Simultaneously with the cut 70 being made, the cutter 144 makes a similar cut 72 at the base of the flap 30, in line with the edge 10 of the blank. However, in this case, as it is positioned above the blank, the cutter 144 cuts through the top liner L1 and also the corrugated layer C, leaving the bottom liner L2 uncut. The area of flap 30 to be reduced in thickness is thus delineated from the rest of the blank by the cut 72. Whilst the latter is being made, the flap 30 is held flat by suction applied to the suction box 90.

As the blank continues to be fed by the belts 32, 34 the flap 28 engages the cutter 48 which progressively removes the remaining portions of the liner L2 and the corrugated layer C from that flap. During this operation the flap 28 is held against the bottom of the box 61 by suction applied through the slot 63 and/or by one or more air jets from nozzles (not shown) communicating with a chamber (also not shown) supplied with air at above-atmospheric temperature. Simultaneously, the cutter 148 removes the remaining portions of the liner L1 and the corrugated layer C from the flap 30, with the flap being held flat by suction applied to the suction box 92, and/or by air jets as before. Thus when the flaps 28, 30 pass out of engagement with the respective cutters 48, 148, the flaps 28, 30 comprise only the liners L1 and L2 respectively.

The waste material removed by the cutters 44, 48 is guided by baffle plates 74 (FIG. 4) so that it falls into a trough 76 and is carried away for disposal. For this purpose the trough 76 may be vibrated, or may form part of any suitable type of air conveyor. A similar trough (not shown) is provided to collect waste material removed by the cutters 144, 148. Alternatively the waste material may be removed by means of suction pipes (not shown) positioned adjacent the cutters, as is well known in the box making industry.

After passing away from the cutters 48, 148 the blank is fed to further apparatus (not shown) which forms the blank into a flat tube, as described above.

Figure 8:
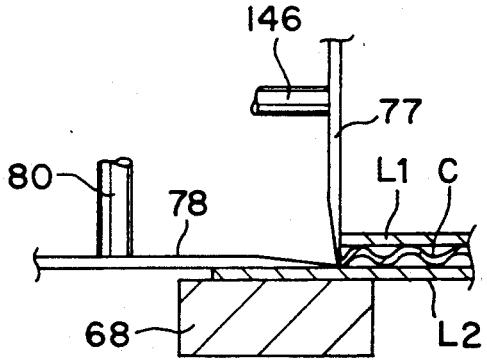
FIG. 8 is a sectional view, taken along the line VIII—VIII in FIG. 5, of a modified form of apparatus according to the present invention.

In a modification, illustrated in FIG. 8, the cutter 144 is replaced by a disc knife 77 fixed on the shaft 146, and the cutter 148 is replaced by a disc knife 78 fixed on a shaft 80 mounted at right angles to the shaft 146 so that the knife 78 rotates in a horizontal plane. In this case the knife 77 makes a cut in the same position as the narrow cut 72 described above, and the knife 78 cuts through the corrugated layer C forming the flap 30 parallel to the liner L2 and as close to that liner as possible without damaging it. The knife 78 extends into the cut made by the knife 77, so that when the flap 30 passes away from the knife 78 the waste material is removed in one piece in any suitable way. Alternatively the knife 78 may be replaced by a milling cutter similar to the cutter 148, but mounted in the same way as the knife 78. It will, of course, be appreciated that the same modification may be made to the cutter 48.

Figure 9:
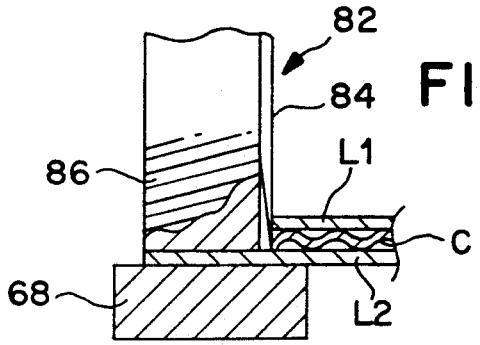
FIG. 9 is a diagrammatic view of another modified form of apparatus.

In a further modification, illustrated in FIG. 9, the waste material is removed from the flap 30 by a cutting unit 82 comprising a disc knife 84 similar to knife 77, and a circular cutter 86 similar to the milling cutter 148. The knife 84 and the cutter 86 may be mounted on a common shaft (not shown) so that, as the blank is fed by the belts 32, 34, the knife 84 makes a cut along the base of the flap 30 to delineate the material to be removed therefrom, and the cutter 86 simultaneously removes that waste material. A similar cutting unit may also, of course, be provided to remove the waste material from flap 28.

It will be appreciated that a disc knife, such as knife 84, could be used in place of each of the cutters 44, 144 in FIGS. 4 to 7.

Figure 10:
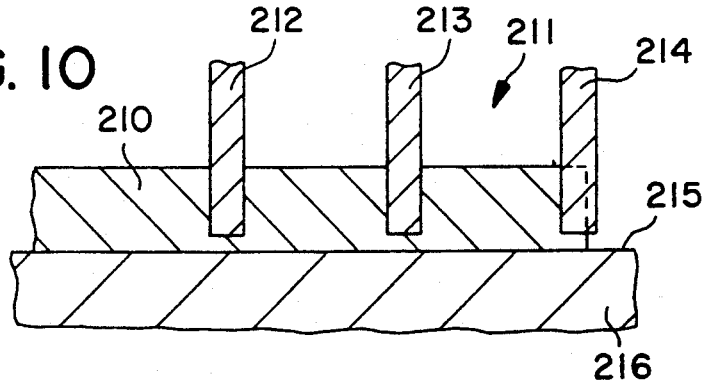
FIG. 10 shows one edge portion of a box blank being machined by three narrow milling cutters in a further embodiment of this invention.
Figure 11:
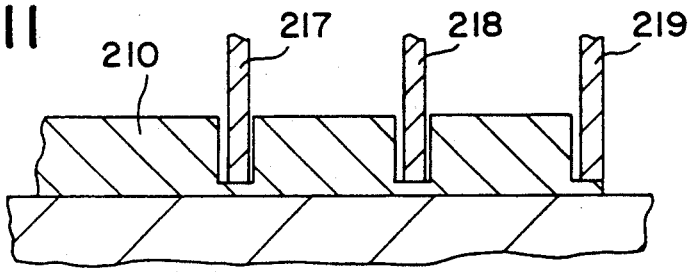
FIG. 11 shows the entry of guide plates into the grooves formed by the narrow cutters.
Figure 12:
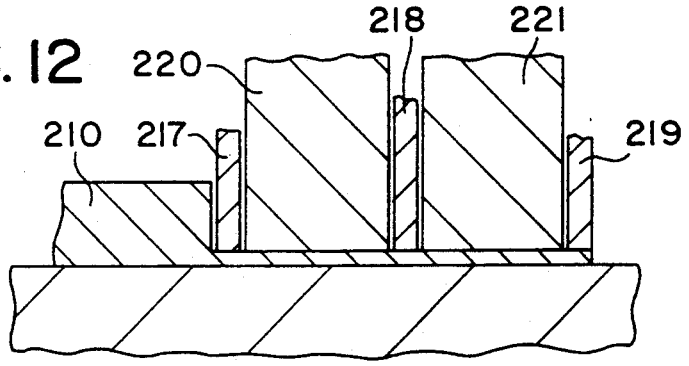
FIG. 12 shows the milling of the material between the three grooves.

FIGS. 10 to 12 show a modification of apparatus. In FIG. 10 a blank 210 is shown having its edge portion 211 operated on by three narrow milling cutters 212, 213 and 214 while the blank is being supported by a guide surface 215 of a member 216. Each of the milling cutters 212 is mounted on a common drive shaft (not shown).

FIG. 11 is a cross-sectional view at a location downstream of FIG. 10 at which three finger-like plates 217, 218 and 219 are shown entering the grooves formed by the milling cutters 212 to 214 so as to engage the bottoms of the grooves. These plates extend in the direction of the movement of the blank so as to hold the edge portion of the blank against the guide surface 215 while two wider milling cutters 220 and 221 (FIG. 12) remove the material lying between the three grooves. The milling cutters 220 and 221 are mounted on a common drive shaft (not shown).

It will be appreciated that a similar set of milling cutters may be arranged to act upon the opposite edge of the blank from below, as described above.

Figure 13:
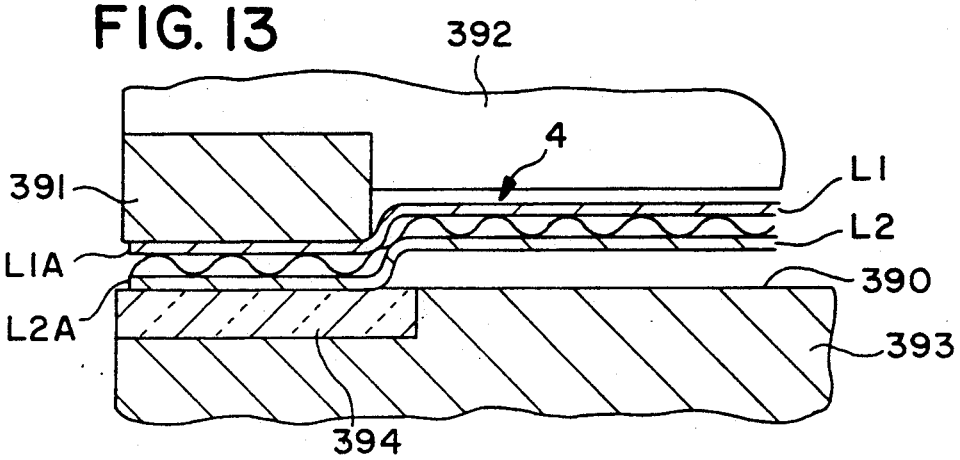
FIG. 13 is a partial sectional view, the same as FIG. 8, showing a second modified form of apparatus according to the present invention.

FIG. 13 shows a modification of the apparatus of FIG. 8 which, like the apparatus of FIG. 8, is located upstream from the cutting knives. As in the other figures, the thickness of the paper forming the upper and lower liners L1 and L2 is exaggerated for the purpose of illustration. FIG. 13 is a transverse cross-section, at one of the creases 4 or 6 shown in FIG. 1 on the side of the blank which is to be reduced to form the flap 30. The portion of the blank shown in FIG. 13 is only a very small portion of crease 4 or 6, and only shows about half of the crease. That is, the offset in the blank shown in FIG. 13, labeled with reference numeral 394, is only one side of the crease.

As shown in the drawing, the effect of each crease 4 and 6 is to raise the liner L2 locally to a position above the bottom surface 390 of the blank. In order to press out the crease in the region of the flap, a rib 391 on a roll 392 is shown in the drawing to press the flap portion L2A of the liner L2 back to the level of the bottom surface 390 of the blank as a whole. The upper liner is similarly pressed downwards by the rib 391 as shown by the position of the portion L1A.

While being deformed by the rib 391 on the roll 392, the blank is supported by a roll 393 of which the periphery is formed partly by a rubber sleeve 394 capable of deforming inwards while crease removal is taking place. For the avoidance of excessive complication, the drawing does not show this deformation, being in effect a view of the blank cross section at the crease shortly after deformation, at a stage at which the deformed part of the blank has recovered slightly so that, as already mentioned, the portion L2A of the lower liner is approximately flush with the lower surface 90 of the remainder of the blank.

This avoids any risk of cutting of the lower liner L2 by the disk knife 78 shown in FIG. 8.

I claim:

1. A method of preparing box blanks of corrugated board, in which blanks of corrugated board having a corrugated core of predetermined thickness and with opposite faces each having a respective liner of a known thickness are fed in succession along a feed path in a direction parallel to opposite edges of the blank which are to be overlapped and joined together to form a flat tube prior to formation into a box, said opposite edges of the blank having portions to be reduced in thickness, in areas of said edges which are to be overlapped and joined together, by cutting means comprising first cutting means for cutting at the same time through liners from opposite faces at opposite edges and, in addition, at least a portion of said corrugated core between said liners on each respective edge of each blank so as to delineate an inner boundary of each corresponding edge portion of said opposite edges to be reduced in thickness, and second cutting means comprising a rotary disk knife in a plane substantially parallel to the plane of the blank for slicing away at the same time a continous strip of material comprising said opposite liners and said corrugated core from each corresponding edge portion of said opposite edges of each blank having a width delineated by the cut performed by said first cutting means and leaving liners of opposite faces at opposite edges that were not delineated by said first cutting means, whereby when said opposite edges reduced in thickness are overlapped and joined, said edges mate along portions of corrugated core having all of said predetermined thickness so that the combined thickness of the overlapping and joined edges exceeds said predetermined thickness only by said thickness of said liners.

2. A method according to claim 1 in which, prior to the second cutting operation, fold creases formed in the blanks are pressed out in the region of the edge portions of the blank to avoid cutting thereof by the second cutting means.

3. Apparatus for preparing box blanks corrugated board comprising corrugated medium having a corrugated core of predetermined thickness and with opposite faces each having a respective liner of a known thickness, said apparatus including:

means for feeding blanks in succession along a feed path in a direction parallel to opposite edges of the blank which are to be overlapped and joined together to form a flat tube prior to formation into a box, said opposite edges of the blank having portions to be reduced in thickness in areas of said edges which are to be overlapped and joined together;

means for cutting each of the blanks, while the blanks are moving along said feed path, said cutting means comprising:

(i) first cutting means which are located along opposite edges of said apparatus for intercepting said moving blanks and for cutting at the same time through said liners from opposite faces at said opposite edges and, in addition, at least a portion of said corrugated core between said liners on each respective edge of each blank so as to delineate an inner boundary of each corresponding edge portion of said opposite edges to be reduced in thickness; and (ii) second cutting means comprising a rotary disc knife located along opposite edges of the apparatus and mounted in a plane substantially parallel to the plane of the blanks for intercepting said moving blanks and slicing away at the same time a continuous strip of material comprising said respective liners and said corrugated core from each corresponding edge portion of each of said opposite edges of each blank having a width delineated by the cut performed by said first cutting means and leaving liners of opposite faces at opposite edges that were not delineated by said first cutting means;

whereby when said opposite edges reduced in thickness are overlapped and joined, said edges mate along portions of corrugated core having all of said predetermined thickness so that the combined thickness of the overlapping and joined edges exceeds said predetermined thickness only by said thickness of said liners.

4. Apparatus according to claim 3 in which the first cutter comprises a milling tool which is narrower than the second cutter to cut a narrow groove in the board.

5. Apparatus according to claim 4 including at least one box member for supporting the blank while it is being cut and having at least one aperture through which suction within the box is transmitted to hold the blank in contact with the box.

6. Apparatus according to claim 3, including means for pressing out folded creases in the blank, in the region of the edge portions of the blank, to avoid cutting thereof by the second cutter.

7. Apparatus according to claim 6 including at least one box member for supporting the blank while it is being cut and having at least one aperture through which suction within the box is transmitted to hold the blank in contact with the box.

8. Apparatus according to claim 3 including at least one box member for supporting the blank while it is being cut and having at least one aperture through which suction within the box is transmitted to hold the blank in contact with the box.

9. Apparatus according to claim 3 including at least one box member for supporting the blank while it is being cut and having at least one aperture through which suction within the box is transmitted to hold the blank in contact with the box.

* * * * *

UNITED STATES PATENT AND TRADEMARK OFFICE

CERTIFICATE OF CORRECTION

PATENT NO. : 5,215,516
DATED : June 1, 1993
INVENTOR(S) : Colin Stutt

It is certified that error appears in the above-indentified patent and that said Letters Patent is hereby corrected as shown below:

Title page, under item [22] insert item [30] Foreign Application Priority Data:

October 4, 1987 [PCT] International ..... PCT/GB87/00703
October 4, 1986 [GB] United Kingdom ..... 8623896

Signed and Sealed this

First Day of February, 1994

Bruce Lehman

*Attest:*

BRUCE LEHMAN

*Attesting Officer*

*Commissioner of Patents and Trademarks*